United States Patent [19]

Chandhoke et al.

[11] Patent Number: 4,977,827

[45] Date of Patent: Dec. 18, 1990

[54] SIGNATURE HANDLING APPARATUS

[75] Inventors: Mohanijit S. Chandhoke, Plattsburgh, N.Y.; Robert A. Bryson, Sr., Huber Heights, Ohio

[73] Assignee: AM International Incorporated, Chicago, Ill.

[21] Appl. No.: 297,577

[22] Filed: Jan. 17, 1989

[51] Int. Cl.[5] ..... B65B 13/00

[52] U.S. Cl. ..... 100/7; 100/14; 414/790; 414/790.8; 414/794.8; 414/928

[58] Field of Search ..... 100/3, 7, 14, 26, 215; 414/417, 799, 789.3, 789.8, 789.9, 790, 790.1, 790.2, 790.8, 790.9, 794.4, 907, 927, 928

[56] References Cited

U.S. PATENT DOCUMENTS

| | | | |
|---|---|---|---|
| 3,095,678 | 7/1963 | Cliff et al. | 100/14 X |
| 3,363,781 | 1/1968 | Magnetti | 414/928 X |
| 4,369,088 | 1/1983 | Ohba et al. | 100/14 X |
| 4,397,229 | 8/1983 | Merwarth et al. | 100/7 X |
| 4,401,021 | 8/1983 | Noll, Jr. | 100/7 X |
| 4,462,735 | 7/1984 | Bain et al. | 414/928 X |
| 4,498,381 | 2/1985 | Convey, Jr. | 100/7 X |
| 4,538,511 | 9/1985 | Wise | 100/7 |
| 4,541,763 | 9/1985 | Chandhoke et al. | 414/790 |
| 4,718,807 | 1/1988 | Baxter | 414/794.8 X |
| 4,820,101 | 4/1989 | Fenn | 414/789.9 X |
| 4,844,686 | 7/1989 | Stevenson | 414/928 X |

FOREIGN PATENT DOCUMENTS

| | | | |
|---|---|---|---|
| 307769 | 1/1969 | Sweden | 414/790.8 |

*Primary Examiner*—Harvey C. Hornsby
*Assistant Examiner*—Stephen F. Gerrity
*Attorney, Agent, or Firm*—Tarolli, Sundheim & Covell

[57] ABSTRACT

A signature handling system is provided to form and handle stacks of signatures. The signature handling system includes a stacker which receives signatures and forms stacks of signatures. A plurality of containers have side-by-side cells to hold the stacks of signatures. A conveyor is provided to sequentially move the containers to the stacker. The stacker includes a loader which loads the signatures into cells of the containers. The loader may be extendable through open sides of cells of the containers to move stacks of signatures downwardly into the cells of the containers through open upper end portions of the cells. The containers may be provided with doors which are movable between an open condition and a closed condition. When the doors are in the closed condition, they at least partially block open sides of the cells to retain stacks of signatures in the cells.

14 Claims, 2 Drawing Sheets

SIGNATURE HANDLING APPARATUS

The present invention relates to an improved system for handling stacks of flat printed products known as signatures or inserts which are to be collated with other printed products to form a magazine, newspaper, etc.

BACKGROUND OF THE INVENTION

It is common practice to print portions of a newspaper, called inserts, and to store these portions prior to collating the newspaper for delivery. It is equally common practice to print portions of a book, magazine, etc. called signatures, and to store these portions prior to collating.

Prior U.S. Pat. No. 4,538,511, to James C. Wise, assigned to the assignee of the present application, entitled "Signature Handling Apparatus", discloses a system for stacking signatures. A transfer vehicle is movable to the stacker to clamp onto a stack and transfer that stack to an adjacent tying station where the stack is tied to form a log or bundle. The transfer vehicle maintains positive engagement with the stack as it moves the stack from the tying station to a stack-delivery station.

Related embodiments of the system of the '511 patent are disclosed in prior U.S. Pat. No. 4,541,763 (Chandhoke et al.), entitled "Apparatus for Forming a Stack of Signatures". This patent is also assigned to the assignee of the present application.

In prior U.S. Pat. No. 4,498,381, to Frank H. Convey, Jr., assigned to the assignee of the present application, there is disclosed a further embodiment of the system of the '511 patent in which there is provided a clamping mechanism capable of bringing end boards to the stacker, and depositing the end boards on the stack as the clamping mechanism engages a stack. The clamping mechanism also has independently movable clamp members that can move to different coextants in applying pressure to different portions of a stack of signatures during the clamping process.

Also in the prior art is U.S. Pat. No. 4,462,735 to Bain et al., which discloses a system for handling newspapers whereby a reserve supply of newspapers can be maintained capable of compensating for unintentional shutdown of a printing press. In the '735 patent, an endless conveyor has carriers adapted to travel about the pathway of the conveyor and to removably support newspaper containers. A pair of spaced transfer conveyors operatively associated with the endless conveyor are adapted to sequentially receive and then return the containers to the endless conveyor. On one transfer conveyor the containers are positioned by an indexing member at a location for receiving a stack of newspapers, and on the other transfer conveyor the containers are indexed to a position where the newspapers are unloaded for further processing.

In co-pending application Ser. No. 261,394, filed Oct. 24, 1988, by Robert A. Bryson, Sr., assigned to the assignee of the present application, there is disclosed an improved handling system for building and handling stacks of flat printed products wherein containers which are used to transport the stacks of printed products are each comprised of a plurality of individual cells, each cell being adapted to accommodate a single stack.

BRIEF DESCRIPTION OF THE PRESENT INVENTION

The present invention resides in an improved system for handling and storing printed products such as inserts and signatures, hereinafter referred to as signatures, prior to their being collated to form a newspaper, magazine, book, etc.

More specifically, the present invention resides in an improved handling system wherein stacks of signatures are placed in a container and handled and stored as a group. By the term "group", for purposes of the present application, it is meant two or more stacks of signatures. By grouping the stacks of signatures in a container, the risk of stacks toppling over or falling off of a pallet is reduced. Also, the risk of damage to signatures is reduced thereby making the collating operation more efficient and less likely to be subject to misfeed problems due to signature damage. Still further, grouping the stacks of signatures facilitates movement of the signatures and overall processing in the printing and collating plant.

In accordance with the present invention, the signatures are stacked and stored in containers, each of which comprises a linear array of side-by-side cells, each cell being adapted to hold a stack of signatures. Each cell has an open side, the open sides of all of the container cells facing in the same direction. The containers are transferred to a stacker which loads stacks of signatures sequentially into successive cells. In a preferred embodiment, each container comprises three cells. The width of each cell is essentially that of a conventional insert or signature, and thus a linear array of three cells occupies substantially the full width of a conventional pallet. Four containers can then be placed on a pallet and occupy substantially the full surface area of a pallet.

BRIEF DESCRIPTION OF THE DRAWINGS

Further features and advantages of the present invention will become apparent to one skilled in the art upon consideration of the following specification, with reference to the accompanying drawings, in which.

DESCRIPTION OF A PREFERRED EMBODIMENT

Figure 1:
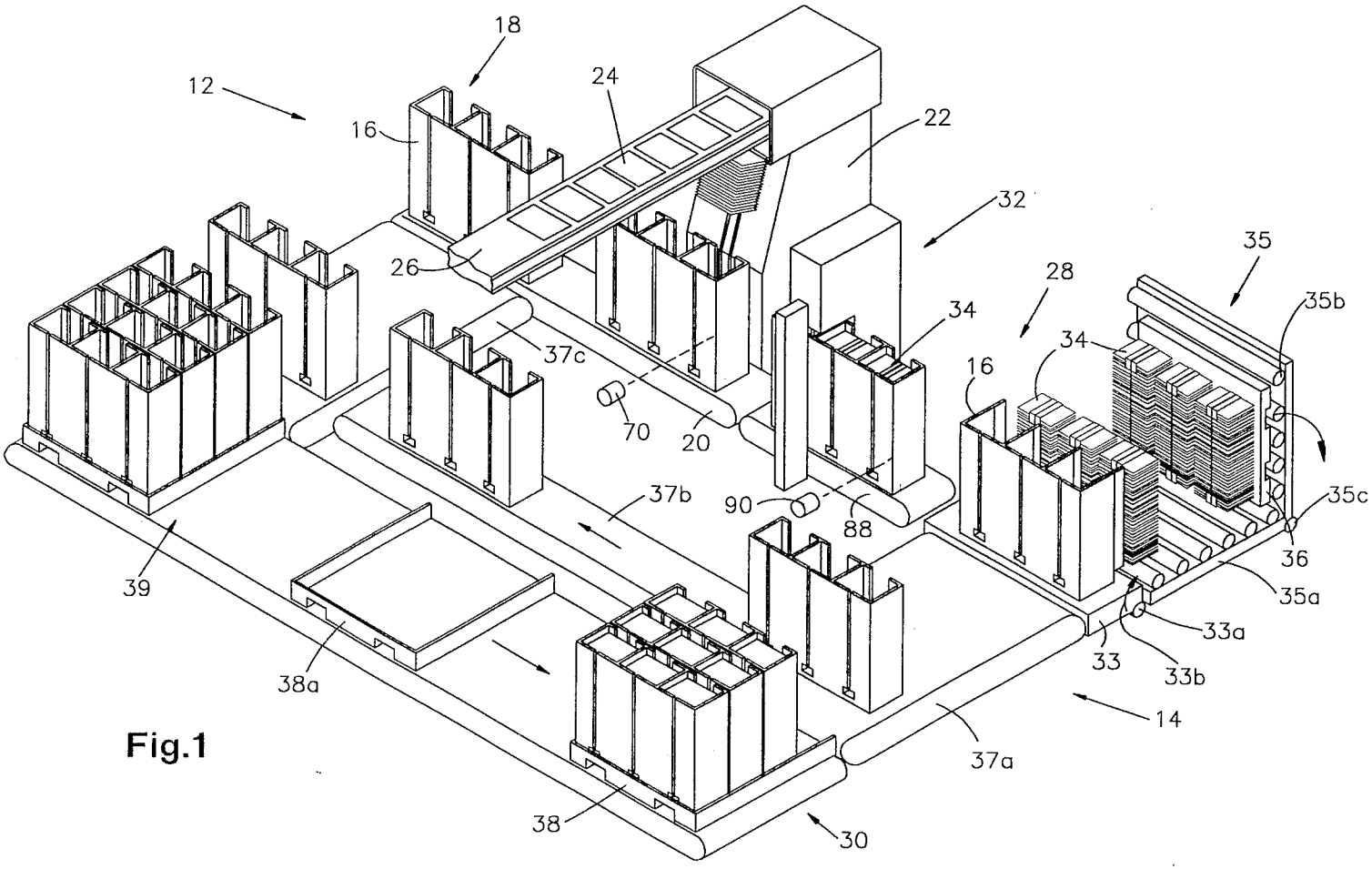
FIG. 1 is a perspective view of a signature handling system in accordance with the concepts of the present invention.

Referring to FIG. 1, the signature handling system 12 of the present invention comprises a conveyor assembly 14 made up of a plurality of sections connected together to form multiple loops to be described. Positioned on the conveyor assembly are a plurality of containers 16, each container comprising three cells 18.

A main run 20 of the conveyor assembly is positioned adjacent to and in front of a stacker 22 adapted to load a stack of signatures into individual cells 18 of the containers 16. These signatures, identified with the numeral 24, are transferred to the stacker from a printing press (not shown) by means of a conveyor 26.

From the stacker 22, the filled containers 16 are moved alternatively either to a transfer station 28 or to a grouping station 30. If moved to the transfer station 28, they may first be positioned and sequentially indexed at a tying station 32 provided with a tyer located thereat. The tyer is adapted to tie the multiple stacks of signatures, in the containers, into bundles or logs 34.

The tying operation can take place for one stack while another stack is being put into an adjacent cell, or after all the cells of a container 16 are filled. In this respect, the tyer can be located adjacent to or remote from the stacker 22. Multiple tyers can be used for simultaneously tying several or all of the stacks of signatures in a container. The use of a tying station is optional in the practice of the present invention.

At the transfer station 28, the containers 16 are positioned on a receiving table 33. This table is pivotable about pivot axis 33*a* in the direction of arrow 33*b*. The amount of pivot is sufficient (e.g., about 30°) to release the tied bundles or logs from the container cells. On release, the bundles or logs move onto a receiving turn device 35. The receiving turn device is provided with a plurality of parallel rollers 35*a* which lie in a plane slanted slightly downward away from the receiving table 33. This allows a group of released bundles or logs to roll downward against a pallet 36. The pallet 36 is secured upright or in a near upright position against rollers 35*b* of the receiving turn device. These rollers 35*b* are in an upright or near upright plane substantially at right angles to the plane of rollers 35*a*. FIG. 1 shows one group of three logs or bundles 34 against pallet 36 and a second group just released onto the rollers 35*a*. The second group of logs or bundles will come to rest against the first group. In the embodiment illustrated, the cluster of rollers 35*a* is sized to accommodate three groups of logs or bundles. When the turn device is fully loaded, it is rotated about its horizontal pivot axis 35*c* so that the group of rollers 35*b* adopt a horizontal or near horizontal orientation. This allows the pallet 36, with, by way of example, three layers of tied logs or bundles 34, to adopt the same orientation and to be rolled or taken away to a subsequent work station.

If the containers 16 are emptied at station 28, the empty containers may be moved by intermediate conveyors 37*a*, 37*b* and 37*c* back to the conveyor assembly main run 20 for reloading at stacker 22.

If the containers 16 following stacking are forwarded by conveyor 37*a* to the grouping station 30, they are grouped upright into groups of four onto a pallet 38. In this sequence, the signatures are not tied, but are moved in the containers to a storage area (not shown) for storage in the containers. Movement to the storage area takes place preferably when a pallet is filled with four containers.

In FIG. 1, there is shown an empty pallet 38*a* ready to be positioned at the grouping station 30 when pallet 38 is fully loaded with four containers and moved away from the grouping station to storage. The pallet 38*a* had previously been moved from a discharge position 39, to the left in FIG. 1, where empty containers were discharged for return to the stacker 22. In a normal sequence, when a book, magazine or newspaper is ready for collating, a pallet with four filled containers will be pulled from storage, forwarded to a processing station where the containers will be unloaded, and then returned to the discharge position 39.

Advantages of the present invention should be readily apparent. The containers can, as indicated above, be easily grouped for convenience, conveyance and storage. The containers are sized, so that when three tyed logs or bundles are unloaded at station 28 and placed horizontally onto a pallet, they occupy essentially the full surface area of the pallet. The present invention permits stacking multiple layers of groups of bundles or logs on a pallet, for instance three layers. This provides an optimum economy of pallet space in a printing or collating plant. Similarly, when groups of containers are grouped together in an upright position at the grouping station, in groups of four, again the containers are sized so that the groups of four containers fully occupy a pallet, providing optimum economy of pallet space.

In addition, the present invention provides optimum stability of the stacks of signatures against accidental dislocation or disturbance during transfer to a work station or storage. For instance, in the case of transfer (at transfer station 28) of the stacks of signatures to a work station, following release from a container, the stacks are horizontally positioned in a side-by-side relationship on a pallet. Thus, one stack tends to buttress another, particularly if the stacks are tied. This is the case even with multiple layers of stacks of signatures on a pallet. Similarly, in the case of transfer of containers to storage, positioning multiple containers one against another on a pallet, causes the containers to buttress one another resisting dislodgement during transfer.

Above it was mentioned that use of tyer 32 was optional. However, tying of the stacks of signatures is preferred when the stacks are to be released from containers 16 at transfer station 28, to maintain the integrity of the stacks and maintain optimum stability of the layers of stacks during pallet movement away from transfer station 28.

Figure 2:
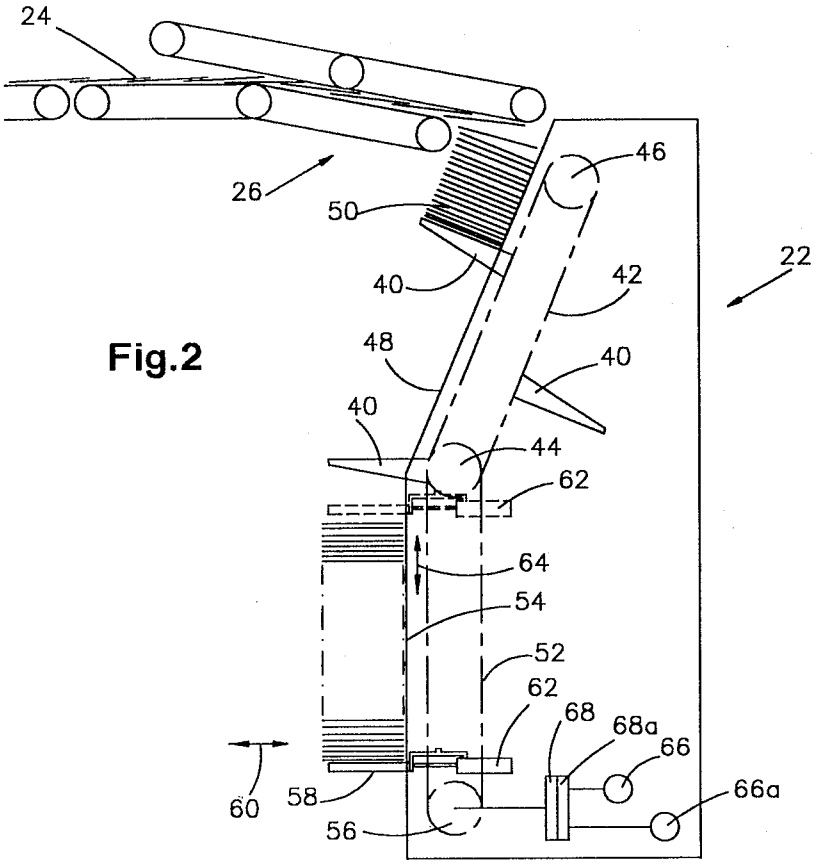
FIG. 2 is a schematic side elevation view of a stacker used in the system of FIG. 1.

Details of the stacker 22 are shown in FIG. 2. The stacker is provided with a plurality of platforms 40 which are mounted on an endless chain mechanism 42 trained around spaced apart sprockets 44 and 46. The chain mechanism 42 is positioned along the inclined front face 48 of stacker 22 so that successive platforms intercept signatures 24 from the signature conveyor 26. Movement of the chain mechanism 42 is timed to move the platforms 40 downwardly along the face 48 of the stacker at the same rate at which a stack 50 of signatures on a platform grows. This keeps the top of a growing stack of signatures at an intercept position registered with conveyor 26.

Whereas only three platforms 40 are shown attached to the chain mechanism 42, there are, in reality, several more, for instance three additional platforms, the exact number being a function of stack height desired, size of equipment and speed of operation of the system components. The spacing between platforms is that necessary to allow one stack to be built before interception of the flow signatures by a following platform and start of a new stack.

Details of the stacking mechanism above-described are disclosed in prior U.S. Pat. No. 4,401,021 to Noll, Jr., assigned to the assignee of the present application, and in prior U.S. Pat. No. 4,718,807 to Baxter, also assigned to the assignee of the present application. The disclosures of U.S. Pat. Nos. 4,401,021 and 4,718,807 are incorporated by reference herein. As disclosed in U.S. Pat. No. 4,401,021, a counter is arranged to count the number of signatures on a platform. Interception of the flow of signatures from conveyor 26 by a successive platform is initiated when a predetermined desired number of signatures are positioned on the platform being loaded.

The chain mechanism 42 is comprised of a pair of co-extensive chains, and alternate platforms are mounted on one chain or the other. The chains are independently movable. As one platform is being loaded, the chain for the next platform is advanced so that this platform is poised for interception of the stream of signatures when loading of the preceding platform is completed. Rapid activation of an intercepting platform is achieved by pivotally mounting the platform on the respective chains. The platforms in the poised position are held in a raised spring-loaded mode by a latch which is adapted to release the platforms to the intercepting mode when loading of the preceding platform is completed. In this way, the continuous movement of the signatures can be maintained without interruption.

As shown in FIG. 2, the chain mechanism 42 and associated platforms are substantially co-extensive with the inclined face 48 of the stacker 22. A second chain mechanism 52 is provided below the mechanism 42 which is substantially co-extensive with the lower vertical face 54 of the stacker. This chain mechanism is trained around a lower sprocket 56 and an upper sprocket (not shown) which is coaxial with sprocket 44.

Attached to the chain mechanism 52 is a fork 58 which is adapted to be moved in and out from the face of the stacker in the direction of arrows 60, actuated by actuator 62, and which is adapted to be moved up and down in the direction of arrows 64 by movement of the chain mechanism 52. The chain 52 is driven by reversible motors 66 and **66*a*, coupled to the chain mechanism through clutch and brake mechanisms 68 and 68*a***. These are arranged to drive the chain at different speeds.

In operation, the fork 58 is initially positioned at its uppermost point of travel (shown in dashed lines in FIG. 2) which is adapted to be slightly above the lowermost point of travel of the platforms 40. The platforms 40 are configured to mesh with and pass by the fork 58 in their downward travel so that a stack of signatures on a platform is transferred from the platform to the fork. The fork on receipt of a stack of signatures is then lowered to its lowermost position (shown in full lines in FIG. 2), actuated by motors 66 and **66*a*. Initially, the stack is reposed on an incline against upper face 48 when positioned on fork 58. In downward movement of the fork, the stack is deflected into a vertical repose by means of a deflecting surface at the point of juncture between the inclined face 48 and the vertical face 54** of the stacker.

As shown in FIG. 1, the containers and cells are positioned by conveyor 20 so that they are immediately in front of the stacker 22. A photocell means 70 registers with the container cell advancing edges to position a cell immediately in front of and contiguous with the vertical face 54. During registration, the fork 58 is in its uppermost position shown in FIG. 2 in dashed lines. The motors 66 and **66*a* are suitably timed to coincide with indexing of the container cells to lower a stack of signatures into a cell subsequent to indexing. This position of a stack of signatures is shown in full lines in FIG. 2. When a stack of signatures reaches the bottom of a cell, the main fork 58 is withdrawn by means of actuator 62 so that the stack rests upon the bottom of the cell, and the container is then indexed for repeat of the above procedure with the next cell. On withdrawal of the fork 58, it is quickly raised by motors 66 and 66*a*** to its uppermost position to receive the next stack of signatures.

Figure 3:
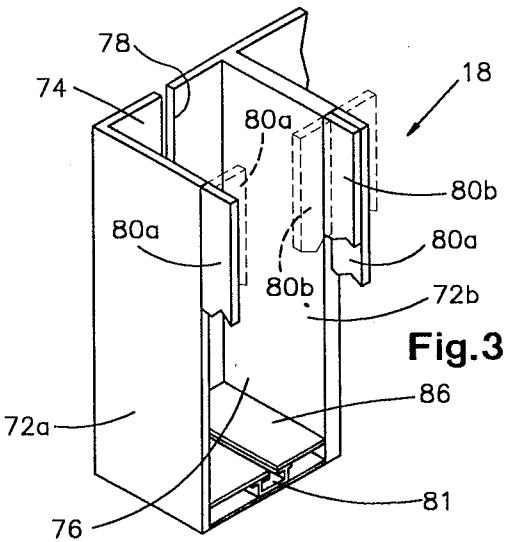
FIG. 3 is a perspective view of part of a container used in the system of FIG. 1, showing details of a container cell.

Details of the container cells 18 are shown in FIG. 3. Each cell is comprised of vertically upstanding side walls **72*a* and 72*b* and a rear wall 74. Intermediate walls between adjacent cells are common to the adjacent cells. The cells are open along the front side 76, and slotted along the rear wall 74 with slots 78. On each of the side walls, along the front side, there is provided hinged doors 80*a* and 80*b*. These are shown in FIG. 3** in an open position, and in a closed position in dashed lines. The doors are biased into the closed position, for instance, by means of springs (not shown), (e.g., conventional springs associated with door hinges) or other means.

In practice, the doors **80*a* and 80*b*** are maintained in a closed position during loading and transfer of the containers from one position to another.

In the embodiment of the present invention illustrated in the drawings, the amount of spring tension biasing the doors **80*a* and 80*b* is sufficient to keep the doors closed during transfer of the containers from one position to another. At the same time, the amount is insufficient to keep the doors 80*a* and 80*b* closed when the containers are tilted on receiving table 33 (FIG. 1) at transfer station 28. The combination of the tilt and pressure of the stacks of signatures against the doors is sufficient to allow release of the stacks of signatures onto the receiving turn device 35**. Alternatively, the doors can be opened by other means for instance magnetic devices, or hydraulic or pneumatic cylinders.

Figure 4:
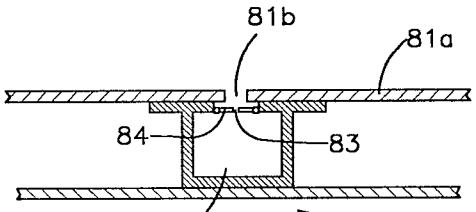
FIG. 4 is a front elevation view of a part of the bottom of the container cell of FIG. 3 showing further details.

As indicated above, details of the tying station 34 are not part of the present invention. The tying mechanism can be that as shown in prior U.S. Pat. No. 4,401,021 referred to above. As shown in the '021 patent, the tyer is comprised of a cylinder means to compress the stack, for instance from about 63 inches to about 48 inches. A frame mechanism embraces the stack. The frame mechanism has a conventional tie head, for instance, one manufactured by Signode Corporation of Chicago, Illinois, sold under the model name "Series MCD". The tie head includes a supply of banding material and a mechanism which feeds the band through a trough which surrounds the stacks. The trough defines a generally rectangular path and is generally U-shaped with a front side which is open towards the inside of the rectangle. In the present invention, a part of the trough is formed in the base 81 of each container cell. This is illustrated in FIG. 4, the trough being identified with the numeral 82. There are three cells 18 in each container, and thus each container has three troughs, one for each cell.

Each trough extends front-to-back midway between the container cell side walls **72*a* and 72*b* (FIG. 3). The troughs are positioned underneath bottom 81*a* of the container cells. The bottom is provided with a front-to-rear slot 81*b* also centered midway between the cell sides 72*a* and 72*b*. Each trough has an upper slot 83 aligned with slot 81*b*. The slots 83 are normally closed by spring biased swing doors 84 which guide the bands while the same are passed around a stack. The doors open in response to tension in the band as it is being tied. The slots 81*b* and 83 communicate with slot 78** in the rear wall of the container cells. This allows the bands to come tight against a signature stack when tying is completed.

In operation, the container cells may be indexed in front of the tying station in the same manner as they are indexed in front of the stacker. For this purpose, the conveyor assembly 14 may be comprised of a separately controllable conveyor section 88 (FIG. 1) controlled by photocell 90. Indexing is adapted to position a container cell so that the slots 81*b*, 83 and 78 align with the tyer band trough. Thus, the tying band is fed through the trough 82 permitting the band to engage and be pulled tight against the opposite sides of the stack. This disclosure of the '021 patent is also incorporated by reference herein.

Having described a preferred embodiment of the invention, I claim:

1. A signature handling system for forming and handling stacks of signatures comprising:

stacker means for receiving signatures and for forming stacks of signatures;

a plurality of containers, each container comprising a linear array of fixedly interconnected and side-by-side cells each having an open side and an open upper end portion, said open sides of said cells facing in the same direction, each cell being capable of holding a stack of signatures; and conveyor means for sequentially moving said containers to said stacker means with the open sides of the cells of each container facing toward said stacker means and for sequentially moving said containers away from said stacker means;

said stacker means including loader means for loading stacks of signatures into cells of said containers, said loader means including means extendable through open sides of cells of said containers for moving stacks of signatures downwardly into cells of said containers through open upper end portions of the cells, and an unloading station and a grouping station, said conveyor means being operable to convey said containers from said stacker means alternatively to said unloading station and to said grouping station, said grouping station including means for supporting a storage pallet and means to position multiple containers in an upright contiguous relationship on said storage pallet.

2. The system of claim 1 wherein said unloading station comprises means for removing stacks of signatures from said container.

3. The system of claim 1 wherein each container cell comprises:

(*a*) wall means defining an elongated, normally vertically oriented chamber having a substantially rectangular cross-section with longitudinally extending sides, said chamber being open along one longitudinal side thereof;

(b) adjacent cells of said containers having a portion of said wall means common to said adjacent cells; and (*c*) door means along said one open longitudinal side and moveable relative to said wall means between a closed position and an open position, said door means at least partially blocking said one open longitudinal side to retain a stack of signatures in a cell when said door means is in the closed position.

4. The system of claim 3 wherein said unloading station comprises positioning means to tilt a container from a vertical orientation to a non-vertical orientation with open sides of said cells facing downwardly, said door means being movable to the open position to release stacks of signatures for movement from the container cells when a container is in a non-vertical orientation.

5. The system of claim 1 including a tying station, tying means at said tying station to band a stack of signatures while in a cell, said conveyor means comprising means to position said cells at said tying means.

6. The system of claim 1 wherein each container comprises three cells.

7. The system of claim 1 wherein each container comprises three cells and has a width dimension, defined as a sum of widths of the container cells, approximately equal to the distance between opposite edge portions of a pallet.

8. The system of claim 7 wherein each container has a front-to-rear dimension whereby four containers positioned front to back substantially fully occupy a surface area of a pallet.

9. A signature handling system for forming and handling stacks of signatures comprising:

stacker means for receiving signatures and for forming stacks of signatures;

a plurality of containers, each container including a linear array of fixedly interconnected and side-by-side cells each having an open side and a plurality of door means movable between an open condition and a closed condition at least partially blocking open sides of the cells, each door means blocking movement of signatures through the open sides of the cells when said door means is in the closed condition;

conveyor means for sequentially moving said containers to said stacker means;

said stacker means including loader means for loading stacks of a signatures into cells of said containers with said door means in the closed condition;

said conveyor means including means for sequentially moving said containers away from said stacker means to a transfer station with stacks of signatures in cells of said containers and with said door means in the closed condition; and unloader means at said transfer station for effecting operation of said door means from the closed condition to the open condition and movement of stacks of signatures out of each of said containers in turn.

10. A signature handling system as set forth in claim 9 wherein said unloader means includes means for tilting the containers from vertical orientations to non-vertical orientations to effect movement of stacks of signatures out of the containers through said door means.

11. An apparatus as set forth in claim 9 wherein each of the cells of a container has an open upper end portion, said loader means including means for moving stacks of signatures downwardly into cells of said containers through open upper end portions of the cells while said door means is in the closed condition.

12. A signature handling system for forming and handling stacks of signatures comprising:

stacker means for receiving signatures and for forming stacks of signatures;

a plurality of containers, each container including a linear array of fixedly interconnected and side-by-side cells each having an open side and a plurality of door means movable between an open condition and a closed condition at least partially blocking open sides of the cells, each cell being capable of holding a stack of signatures, said door means blocking movement of signatures through the open sides of the cells when said door means is in the closed condition;

conveyor means for sequentially moving said containers to said stacker means;

said stacker; means including loader means for loading stacks of signatures into cells of said containers;

said conveyor means including means for sequentially moving said containers away from said stacker means to a transfer station with stacks of signatures in cells of said containers and with said door means in the closed condition; and unloader means at said transfer station for effecting operation of said door means from the closed condition to the open condition and movement of stacks of signatures out of each of said containers in turn, said unloader means includes means for tilting the containers from vertical orientations to non-vertical orientations to effect movement of stacks of signatures out of the containers through said door means.

13. An apparatus as set forth in claim 12 wherein each of the cells of a container has an open upper end portion, said loader means including means for moving stacks of signatures downwardly into cells of said containers through open upper end portions of the cells while said door means is in the closed condition.

14. A signature handling system for forming and handling stacks of signatures comprising:

stacker means for receiving signatures and for forming stacks of signatures;

a plurality of containers, each container including a linear array of fixedly interconnected and side-by-side cells each having an open side and a plurality of door means movable between an open condition and a closed condition at least partially blocking open sides of the cells, each cell being capable of holding a stack of signatures, each of the cells of a container having an open upper end portion, said door means blocking movement of signatures through the open sides of the cells when said door means is in the closed condition;

conveyor means for sequentially moving said containers to said stacker means;

said stacker means including loader means for loading stacks of signatures into cells of said containers;

said conveyor means including means for sequentially moving said containers away from said stacker means to a transfer station with stacks of signatures in cells of said containers and with said door means in the closed condition; and unloader means at said transfer station for effecting operation of said door means from the closed condition to the open condition and movement of stacks of signatures out of each of said containers in turn, said loader means including means for moving stacks of signatures downwardly into cells of said containers through open upper end portions of the cells while said door means is in the closed condition.

* * * * *

UNITED STATES PATENT AND TRADEMARK OFFICE

CERTIFICATE OF CORRECTION

PATENT NO. : 4,977,827

DATED : December 18, 1990

INVENTOR(S) : Mohanijit S. Chandhoke, and Robert A. Bryson

It is certified that error appears in the above-identified patent and that said Letters Patent is hereby corrected as shown below:

Column 8, Line 27, Claim 9, after "each" insert --cell being capable of holding a stack of signatures, said--.

Column 9, Line 5, Claim 12, delete ";".

Signed and Sealed this

Twelfth Day of May, 1992

*Attest:*

DOUGLAS B. COMER

*Attesting Officer*

*Acting Commissioner of Patents and Trademarks*